US006076986A

United States Patent [19]

Manno

[11] Patent Number: 6,076,986

[45] **Date of Patent: *Jun. 20, 2000**

[54] WRITING IMPLEMENT AND PICK ASSEMBLY

[76] Inventor: Robert C. Manno, 18601 Demion La. #A, Huntington Beach, Calif. 92646

[ * ] Notice: This patent is subject to a terminal disclaimer.

[21] Appl. No.: 09/203,002

[22] Filed: Nov. 30, 1998

Related U.S. Application Data

[63] Continuation-in-part of application No. 08/485,820, Jun. 6, 1995, abandoned, and a continuation of application No. 08/741,472, Oct. 30, 1996, Pat. No. 5,865,552.

[51] Int. Cl.[7] ..... B43K 29/00

[52] U.S. Cl. ..... 401/195; 401/52

[58] Field of Search ..... 401/52, 192, 195; 132/328

[56] References Cited

U.S. PATENT DOCUMENTS

| | | | |
|---|---|---|---|
| 1,124,651 | 1/1915 | Peterson | 401/52 X |
| 1,220,792 | 3/1917 | Smith, Jr. | 401/52 |
| 1,456,786 | 5/1923 | De Luca | 401/195 X |
| 1,538,641 | 5/1925 | Liljequist | 401/52 X |
| 1,598,427 | 8/1926 | Easton | 401/195 X |
| 2,382,206 | 8/1945 | Compton | 401/52 |
| 5,009,535 | 4/1991 | Oilar | 401/195 |
| 5,046,212 | 9/1991 | O'Conke | 132/328 X |
| 5,409,022 | 4/1995 | Elias | 132/328 |
| 5,865,552 | 2/1999 | Manno | 401/195 |

*Primary Examiner*—David J. Walczak
*Attorney, Agent, or Firm*—John J. Connors; Connors & Assoc.

[57] ABSTRACT

An assembly 10 of a writing implement 12 and a pick 13. The pick 13 is attached by a hinge 32 to a spring clip 18 for holding the writing implement 12 to a user's pocket. The hinge 32 enables the pick 13 to move between a first position where the pick is disposed in a slot in the spring clip and a second position where the pick extends outward from the slot. The pick 13 comprises a generally conically shaped body made of a polymeric material that is unlikely to injure the gums of a user and terminates in a point.

10 Claims, 2 Drawing Sheets

2
2
10
12
13
14
15
16
17
18
18a
20
22
24
28
28a
30
32
34
39
32a
110
111
111a
112
114
11
11

8
8
10
9
110
111
111a
112
116
118
120
122
12
13
16
18
18a
22
28
28a
30
32
32b
40
42
44
50
50a
50b
52
52a
56

WRITING IMPLEMENT AND PICK ASSEMBLY

RELATED PATENT APPLICATIONS

This application is a continuation-in-part application of U.S. Ser. No. 08/485,820, entitled "Writing Implement & Pick Assembly," filed Jun. 6, 1995 abandoned, and a continuation of U.S. Ser. No. 08/741,472, entitled "Writing Implement & Pick Assembly," filed Oct. 30, 1996 now U.S. Pat. No. 5,865,552. These related applications are incorporated herein by reference and made a part of this application.

BACKGROUND OF THE INVENTION

1. Field of the Invention

This invention relates to a pick which is attached to a spring clip of a writing implement.

2. Background Discussion

It is common for an individual to chew upon the end of a writing implement while engaged in thought or during times of stress or boredom. Likewise, one frequently sees individuals enlisting the aid of various non-functional items to be utilized as a pick. Such non-functional items as bobby pins, paper clips, nail files, staples and even rubber bands have all been used as a pick.

SUMMARY OF THE INVENTION

It is the object of this invention to provide a unique assembly of a writing implement and a pick.

The assembly of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include compactness, convenience in finding and using a pick, and avoidance of misplacing the pick.

The first feature of this invention is that it includes an assembly of a writing implement and a pick. The writing implement has at one end thereof an elongated spring clip member for holding the writing implement in a pocket. The spring clip member has a body with an elongated slot therein. The typical writing implement, such as, for example, a pen or mechanical pencil, has a central, longitudinal axis with a writing tip at the end of the longitudinal axis. In one embodiment of this invention, the spring clip with the pick is attached directly to the writing implement. In this case, the spring clip member with the pick is at the end of the writing implement opposite the writing tip. In another embodiment of this invention, the writing tip is covered by a cap member and the spring clip member with the pick is attached to the cap member.

The second feature is that the body of the spring clip member is disposed lengthwise substantially parallel to the longitudinal axis of the writing implement. Preferably, the elongated slot is open on one side and this slot is elongated and disposed lengthwise substantially parallel to the longitudinal axis of the writing implement. The pick fits snug within the slot, and is held in position by friction.

The third feature is that the pick is attached to the body of the spring clip to move between a first position where the pick is disposed in the slot and a second position where the pick extends outward from the slot. The pick has a length which is less than the length of the slot and a width about equal to the width of the slot. In accordance with this invention, the pick comprises an generally conically shaped body made of a polymeric material that is unlikely to injure the gums of a user and terminates in a point. Preferably, the pick is attached at one end to the body by a hinge element. Thus, the pick may be manually manipulated to pivot and move in and out of the slot but remain attached permanently to the spring clip. The pick may have a detent element which engages a wall of the slot to hold the pick in the first position until manually moved to the second position. Other ways of attaching the pick are also possible. For example, the pick may be mounted to slide in and out of the slot.

DESCRIPTION OF THE DRAWING

The preferred embodiment of this invention, illustrating all its features, will now be discussed in detail. This embodiment depicts the novel and non-obvious pen and pick assembly of this invention as shown in the accompanying drawing, which is for illustrative purposes only. This drawing includes the following figures (FIG.) with like numerals indicating like parts.

DETAILED DESCRIPTION OF THE PREFERRED EMBODIMENTS

Figures 1, 2, 3, 10, 11:
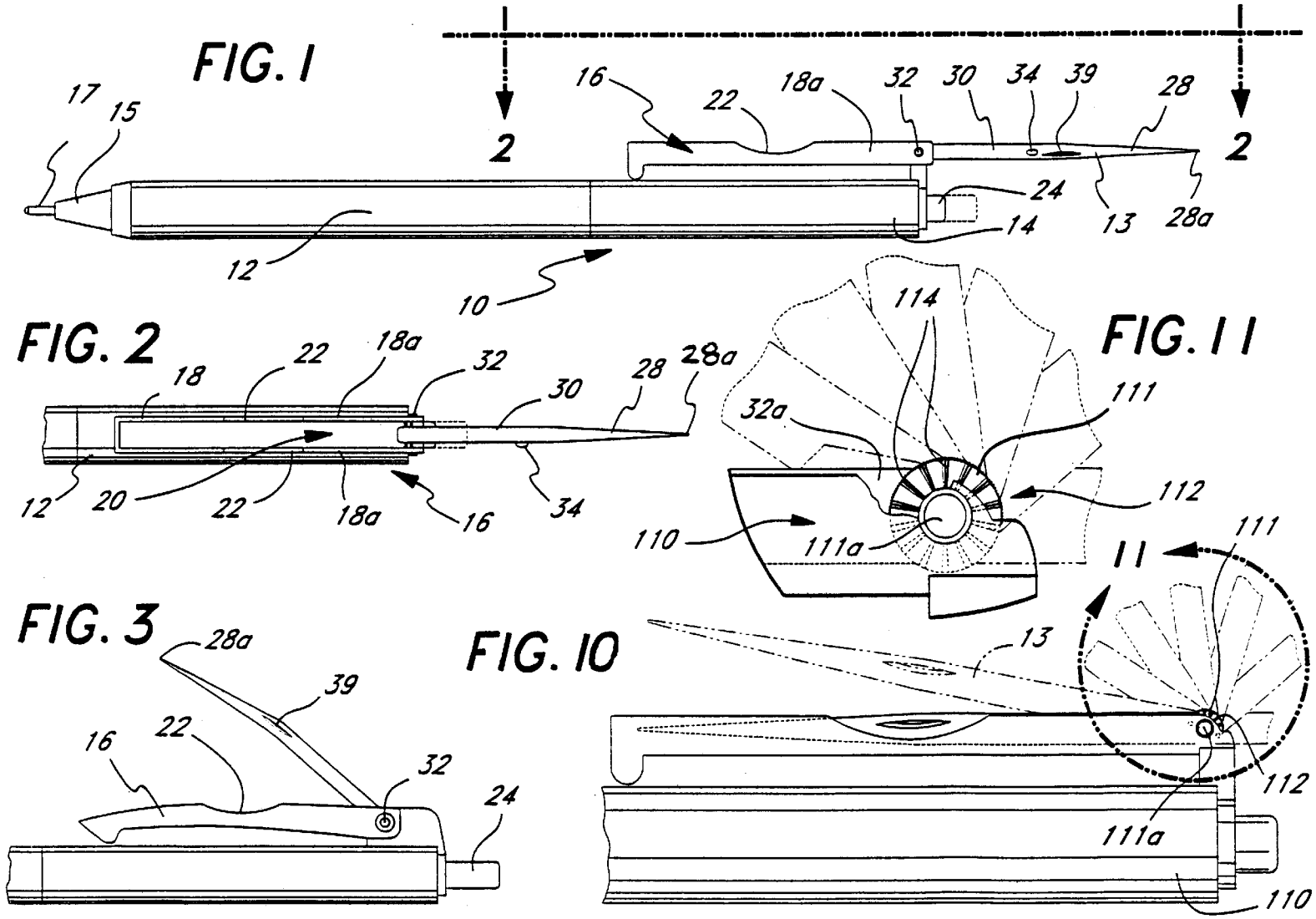
FIG. 1 is a side elevational view of one embodiment a writing implement and pick assembly of this invention showing the pick in a fully open position.
FIG. 2 is a cross-sectional view taken along line 2—2 of FIG. 1.
FIG. 3 is a side elevational view of the writing implement and pick, assembly shown in FIG. 1 where the pick is being moved from an open to a closed position.
FIG. 10 is an enlarged fragmentary view taken along line 10 of FIG. 7.
FIG. 11 is an enlarged fragmentary view taken along line 11 of FIG. 10.

As best illustrated in FIGS. 1, 2 and 3, the assembly 10 of this invention includes a writing implement 12 and a pick 13. The writing implement 12 has at one end 14 an elongated spring clip 16 and at the opposite end 15 a writing tip 17. This writing tip 17 is at the terminal end of the longitudinal axis of the writing implement 12. The writing implement 12 is of conventional design, and it has at the end 14 a plunger 24 that is depressed to extend the writing tip 17 outward. The spring clip 16 has a body 18 with an elongated slot 20 therein having a length of from about 1 to 2 inches and a width of from about 1/16 to 1/8 inch. The pick 13 has comparable dimensions. The side walls 18*a* of the body 18 have opposed cut-away sections 22, and the body is disposed lengthwise substantially parallel to the longitudinal axis of the writing implement 12.

The pick 13 has a conical section 28 with a pointed tip 28*a* and a mounting section 30. In accordance with this invention, the pick is made of a polymeric material that is unlikely to injure the gums of a user. Suitable polymeric material includes polyethylene, polypropylene, or nylon. The mounting section 30 is attached by a hinge 32 to the body 18 of the spring clip 16 so that the pick pivots about the hinge. In FIGS. 1 and 2, the pick 13 is shown in the open position with the pick fully extended outward from the slot 20. FIG. 3 depicts the pick 13 being manually closed. There is a detent 34 on the side of the mounting section 30 that provides a friction fit between the inside of the side walls 18*a* and the detent when the pick 13 is pivoted to move it into the slot 20. Thus, the pick 13 is housed safely in the spring clip 16 when not in use, but is easy to access when needed. A groove 39 in the pick 13 allows the user to insert his or her finger nail in the groove to pull the pick from the slot 20, causing the pick to pivot about the hinge 32.

Figures 4, 5, 6, 7, 8, 9:
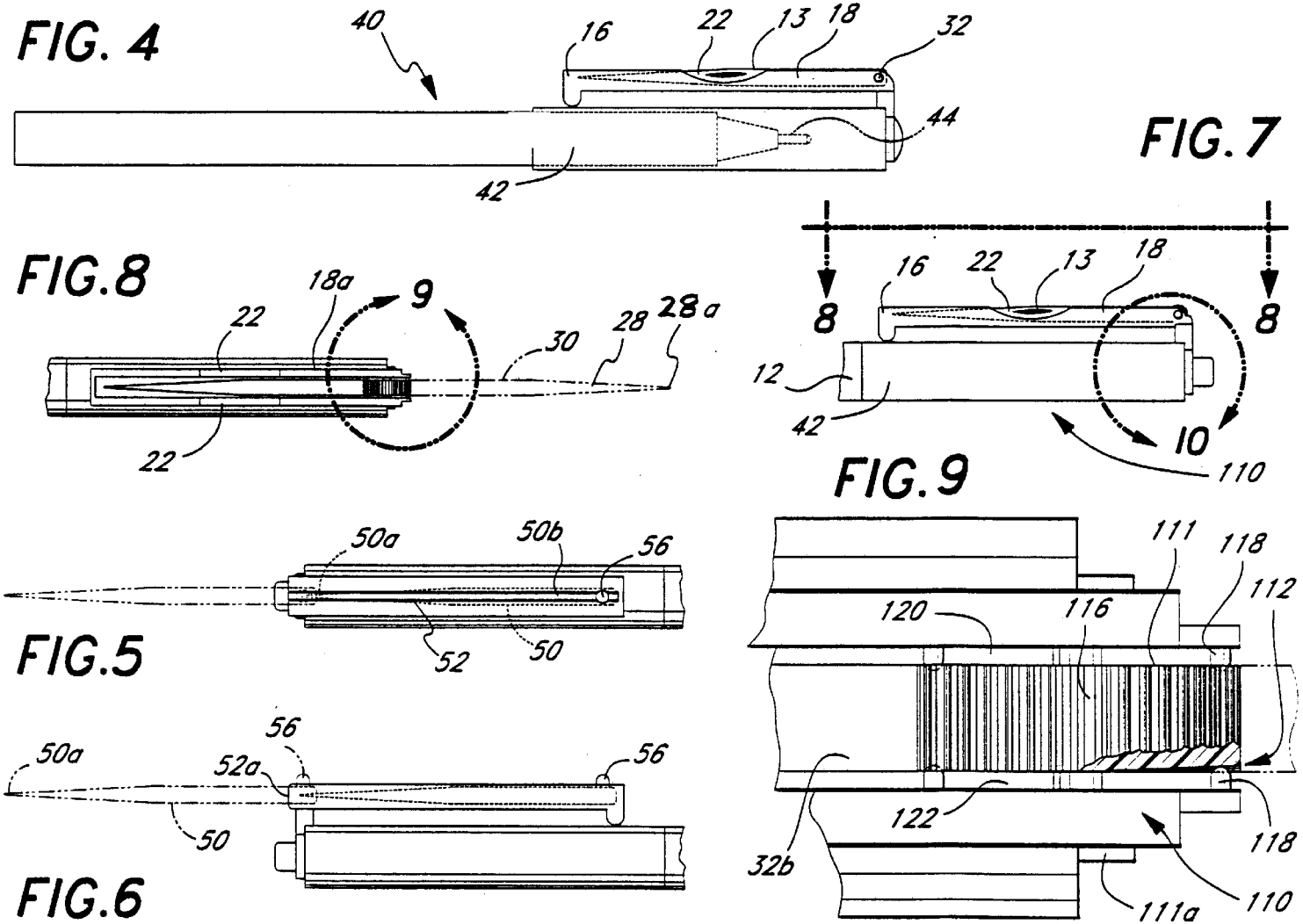
FIG. 4 is a fragmentary side elevational view of the embodiment of this invention shown in FIG. 3 with the pick partially open.
FIG. 5 is a fragmentary top plan view of an alternate embodiment of this invention employing a pick mounted to slide in and out of a slot in a spring clip for a writing implement.
FIG. 6 is a fragmentary side elevational view of the embodiment of this invention shown in FIG. 5.
FIG. 7 is a fragmentary side view of an alternate embodiment of this invention.
FIG. 8 is a plan view of the alternate embodiment of this invention shown in FIG. 7.
FIG. 9 is an enlarged fragmentary view taken along line 9 of FIG. 8.

The alternate embodiment shown in FIG. 4 depicts a writing implement 40 which has a removable cap member 42 that covers the writing tip 44 of the implement. The writing tip 44 does not retract, and the cap member 42 is removed when the implement is used. In this embodiment, the spring clip 16 with the pick 13 is affixed to the cap member. The detent 34 is not employed, Consequently, the dimensions of the slot 20 and the pick 13 are almost identical so that upon closing there is a tight friction fit to hold the pick in the closed position until manually pulled from the slot 20.

Another embodiment is shown in FIGS. 5 and 6 where the pick 50 is mounted to slide in and out of a slot 52 in a spring clip 54. The slot 52 is open at its end 52*a* and the pointed end 50*a* of the pick 50 is adjacent this end when the pick is in the retracted position as shown in solid lines. The opposed end 50*b* of the pick 50 has a raised lever 56 which is used to push the pick to the left as shown in FIGS. 5 and 6 to move the pick outward from the slot 52. The slot 52 preferably tapers inward towards its end 52*a*, so that the pick 50 is held in the extended position by friction, yet easily return to the retracted position by pushing it to the right as shown in FIGS. 5 and 6.

As shown in FIGS. 7 through 11, an alternate embodiment of the invention, the assembly 110 is provided. This assembly includes the writing implement 12 and the pick 13. The principal difference between this embodiment and that shown in FIGS. 1 through 6 is the use of a hinge mechanism 112 that allows the pick to assume a plurality of positions between its retracted position and extended position.

The hinge mechanism 112 includes a central wheel 111 with notches 114 (FIG. 11) in its sides and notches 116 (FIG. 9) in its edge. The wheel 111 is fixedly connected to the pick 13 at its end 32*b*, but mounted to rotate about its axis 111*a*. Thus, as the pick is manually moved between its retracted position and extended position, the wheel 111 is rotated. The wheel is seated between two stationary members 120 and 122 (FIG. 9) which each have finger element 118 engaging the notches 116. When a finger is opposite a notch it holds the pick in a partially extended position as shown in FIGS. 10 and 11.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent, Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A writing implement and pick assembly, including a writing implement having at one end thereof an elongated spring clip member for holding the writing implement in a pocket, said spring clip member having a body with an elongated slot therein, and a single pick comprising a substantially conically shaped body made of a polymeric material that is unlikely to injure the gums of a user and terminating in a point, said pick being attached to the body to move between a first position where the pick is disposed in said slot and held in said first position by friction and a second position where the pick extends outward from the slot.

2. The writing implement and pick assembly of claim 1 where the pick is attached at one end thereof by a hinge element to the spring clip.

3. The writing implement and pick assembly of claim 1 where the pick is mounted to slide in and out of the slot.

4. A writing implement and pick assembly, including a writing implement having a central, longitudinal axis with a writing tip at the end of said longitudinal axis, said writing tip being covered by a cap member, said cap member including an elongated spring clip member for holding the writing implement in a pocket, said spring clip member having a body disposed lengthwise substantially parallel to the longitudinal axis of the writing implement with an open elongated slot disposed lengthwise substantially parallel to the longitudinal axis of the writing implement, and a single pick having a length which is less than the length of the slot and a width about equal to the width of the slot, said pick comprising a substantially conically shaped body made of a polymeric material that is unlikely to injure the gums of a user and terminating in a point, said pick being attached to the body to move between a first position where the pick is disposed in said slot and a second position where the pick extends outward from the slot, a detent element for holding by friction the pick in the first position until manually moved to the second position, said slot having a length of from 1 to 2 inches and a width of from 1/16 to 1/8 inch, and the pick having comparable dimensions.

5. The writing implement and pick assembly of claim 4 where the pick is attached at an end thereof to the spring clip by a hinge.

6. The writing implement and pick assembly of claim 4 where the pick is mounted to slide in and out of the slot.

7. A device, including spring clip adapted to hold a writing implement in a pocket and a single pick mounted to the spring clip to move between a closed position to an open position, said pick comprising a substantially conically shaped body made of a polymeric material that is unlikely to injure the gums of a user and terminating in a point.

8. The device of claim 7 including an elongated slot within the spring clip member, said slot receiving and housing the pick.

9. The device of claim 8 where the spring clip with the pick are attached to a writing implement.

10. The device of claim 8 where the spring clip with the pick is attached to a cap for covering the tip of a writing implement.

* * * * *